United States Patent [19]

Chapin

[11] Patent Number: 4,482,195

[45] Date of Patent: Nov. 13, 1984

[54] ARTICLE OF FURNITURE

[76] Inventor: Richard M. Chapin, Rte. 6, Box 668, Mooresville, N.C. 28115

[21] Appl. No.: 522,006

[22] Filed: Aug. 11, 1983

[51] Int. Cl.[3] ..... A47B 43/00

[52] U.S. Cl. ..... 312/210; 312/140.2; 312/258; 312/262

[58] Field of Search ..... 108/99, 111; 211/195; 312/140.2, 210, 262, 258

[56] References Cited

U.S. PATENT DOCUMENTS

| | | | |
|---|---|---|---|
| 122,179 | 12/1871 | Lawrence et al. | 312/258 |
| 228,141 | 5/1880 | Tocci | 312/258 |
| 364,796 | 6/1887 | Brolaski | 312/258 |
| 1,105,381 | 7/1914 | Stovall | 312/140.2 |
| 1,188,974 | 6/1916 | Montgomery | 312/258 |
| 1,202,205 | 10/1916 | Montgomery | 312/258 |
| 2,430,241 | 11/1947 | Nicholas | 312/210 |
| 2,549,379 | 4/1951 | Liebel | 312/210 X |
| 2,808,305 | 10/1957 | Jackson | 312/140.2 |

OTHER PUBLICATIONS

Science & Mechanics, published 4–1955, p. 126.

*Primary Examiner*—William E. Lyddane

*Assistant Examiner*—Joseph Falk

*Attorney, Agent, or Firm*—Bell, Seltzer, Park & Gibson

[57] ABSTRACT

First and second major components are folded into a compact knock-down condition for storage and shipment and may be quickly and easily erected and assembled to form a rigid caselike article of furniture. The first major component includes a rectangular front panel with drawer openings and a pair of rectangular end panels hingedly connected to opposed side edges of the front panel so that the end panels may be positioned in an inwardly folded compact position when in kit form and may be unfolded to a position at right angles to the front panel in preparation for assembly. The second major component of the kit includes a rectangular rear panel and a rectangular top panel hingedly connected to the upper side edge of the rear panel so that the top panel may be positioned in an inwardly folded compact position against the rear panel when in kit form and may be unfolded to a position at right angles to the rear panel in preparation for assembly. The first and second major components may easily be unfolded and fitted together in a rigid manner to form the rigid caselike article of furniture.

4 Claims, 11 Drawing Figures

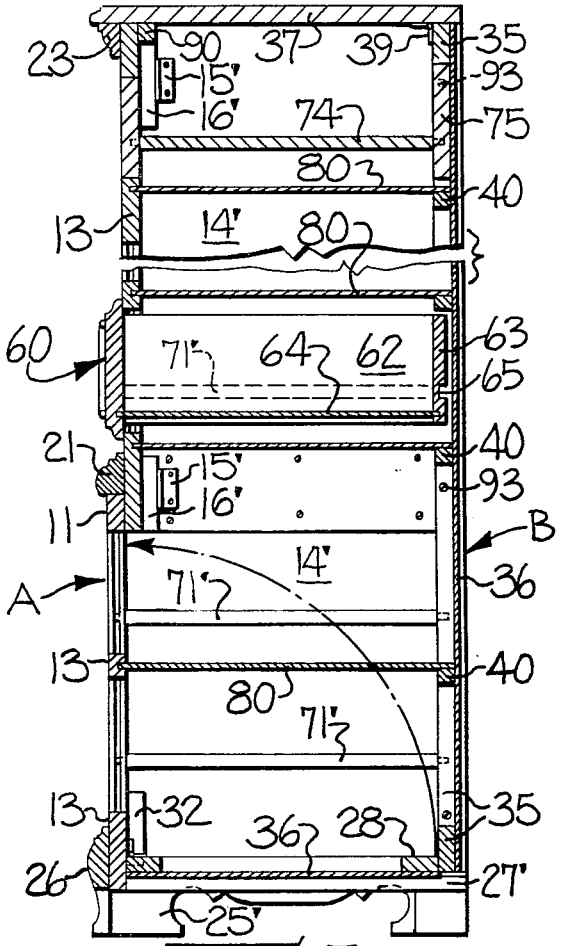
Fig-7
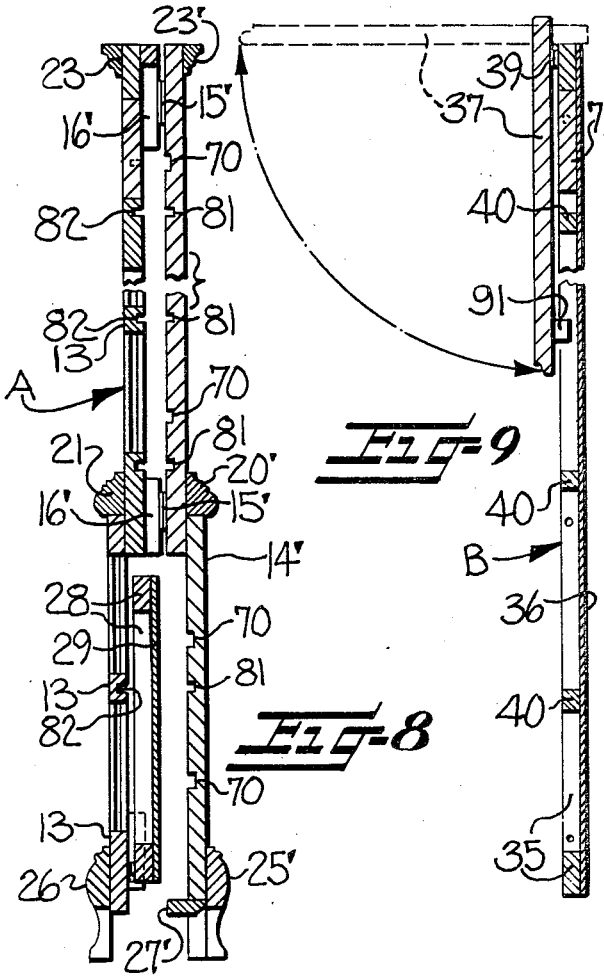
Fig-9
Fig-8
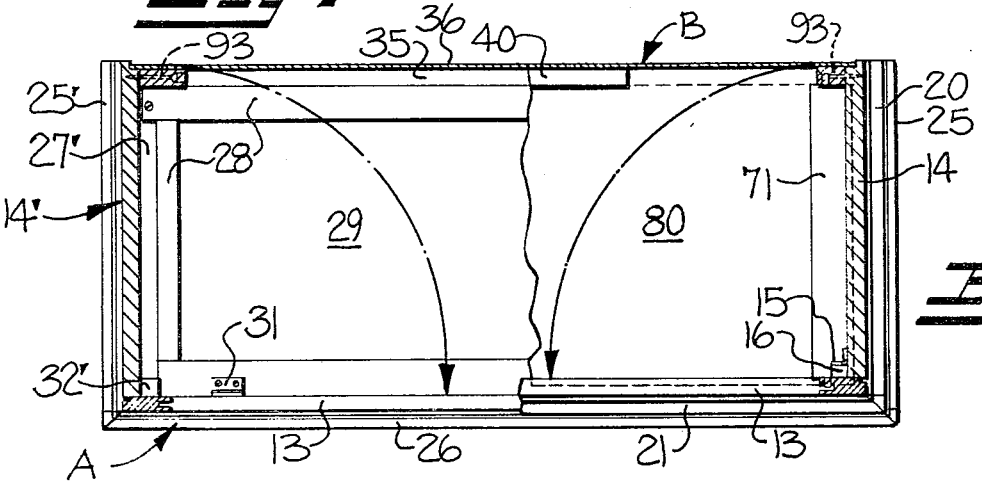
Fig-10
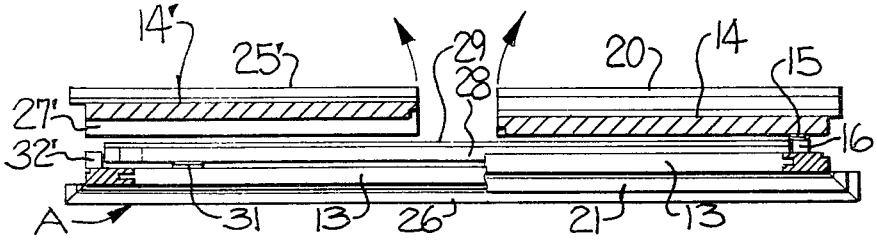
Fig-11

ARTICLE OF FURNITURE

FIELD OF THE INVENTION

This invention relates generally to a compact furniture kit and more particularly to such a furniture kit which includes first and second major components folded into a compact knock-down condition for storage and shipment and being quickly and easily erected and permanently assembled into a rigid caselike article of furniture.

BACKGROUND OF THE INVENTION

It is generally known to provide caselike articles of furniture with the major components being foldable into a compact, knock-down condition for storage and shipment. The major components are hingedly connected together so that they may be easily assembled and also disassembled and returned to the compact, knock-down condition for further shipment or storage. Examples of this earlier known type of knock-down furniture are illustrated in U.S. Pat. Nos. 122,179; 228,141; 364,796; 1,188,974; and 1,202,205. Because this type of furniture must be designed so that it can be easily disassembled and returned to the compact folded kit condition, it does not have the same desired rigidity as conventional caselike articles of furniture, and in many cases also has the appearance of knock-down furniture which can usually be distinguished from conventional furniture.

SUMMARY OF THE INVENTION

In contrast to the known types of knock-down furniture, it is an object of the present invention to provide a compact furniture kit adapted to be maintained in a folded and compact knock-down condition for storage and shipment and easily assembled in a permanent manner so that the caselike article of furniture is as rigid as conventional types of furniture and has substantially the same appearance.

The compact furniture kit of the present invention is formed of first and second major components which are maintained in a compact folded condition. The first major component includes a rectangular front panel with drawer openings therein and a pair of rectangular end panels hingedly connected to opposed side edges of the front panel with the end panels positioned in inwardly folded compact position and parallel to the front panel when in kit form. The end panels are unfolded to a position at right angles to the front panel in preparation for assembly. The second major component includes a rectangular rear panel and a rectangular top panel hingedly connected to the upper edge of the rear panel so that the top panel is positioned in an inwardly folded compact position against the rear panel when in kit form. The top panel is unfolded to a position at right angles to the rear panel in preparation for assembly. The first and second major components may be easily unfolded and permanently connected together so that the first and second components are assembled into a permanent and rigid caselike article of furniture. The compact kit also preferably includes a bottom panel hingedly connected to the lower edge of the front panel and foldable into compact condition against the inner surface of the front panel when in kit form.

The hinges connecting the end panels to the front panel, connecting the bottom panel to the front panel, and connecting the top panel to the rear panel are hidden from frontal and side views when in unfolded position. Thus, all of the hinges are hidden from view when the furniture is assembled and the furniture has the same outward appearance, when assembled, as conventional furniture. However, the present furniture may be stored and shipped in less than half the space of conventional furniture.

The front panel is preferably provided with at least one drawer opening extending from substantially one side to the other and drawer slide bars are provided on the inner surfaces of the end panels for slidably supporting drawers thereon. The drawer slide bars may extend along the entire width of the end panels and opposite ends may be supported by dowels extending into the corresponding front and rear panels.

BRIEF DESCRIPTION OF THE DRAWINGS

Other objects and advantages will appear as the description proceeds when taken in connection with the accompanying drawings, in which

FIG. 7 is a vertical sectional view taken substantially along the line 7—7 in FIG. 1 and with a medial section of the upper portion broken away;

FIG. 8 is a vertical sectional view taken substantially along the line 8—8 in FIG. 5;

FIG. 9 is a vertical sectional view taken substantially along the line 9—9 in FIG. 5;

FIG. 10 is a horizontal sectional view taken substantially along the line 10—10 in FIG. 1; and FIG. 11 is a horizontal sectional view similar to FIG. 10 but showing the end panels in inwardly folded position relative to the front panel.

DESCRIPTION OF THE ILLUSTRATED EMBODIMENT

Figure 5:
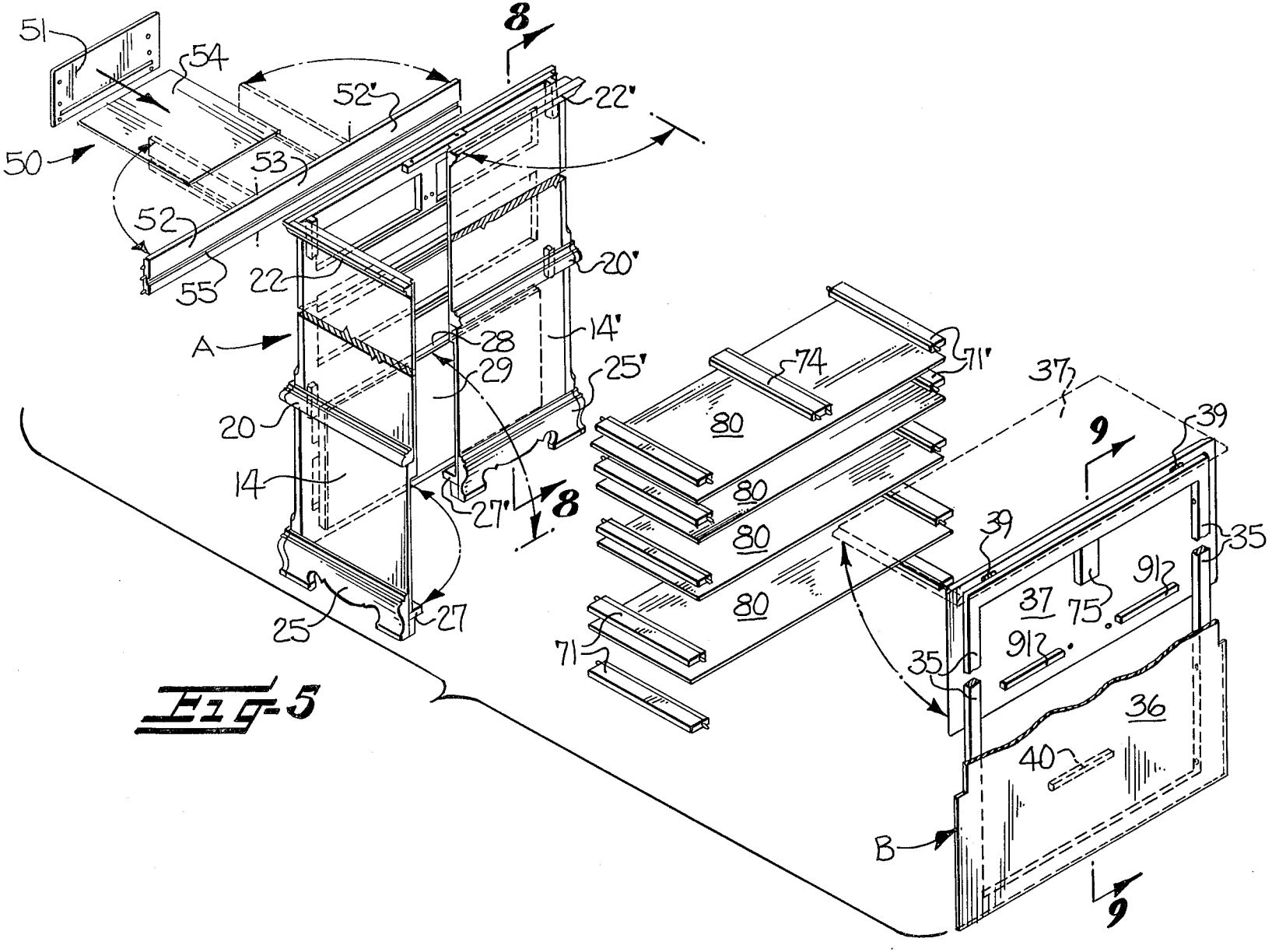
FIG. 5 is an exploded isometric view of the furniture kit illustrating some of the parts in unfolded condition in preparation for assembly and showing some of the parts broken away for clarity.

The compact furniture kit of the present invention is illustrated in the drawings as forming a rigid chest-on-chest type of article of furniture. However, it is to be understood that the furniture kit may form various other types of caselike articles of furniture, such as single chests, dressers, bureaus, or wardrobes and the like. As best illustrated in FIG. 5, the compact furniture kit includes a first major component, broadly indicated at A, and a second major component, broadly indicated at B.

The first major component A (FIG. 6) includes a rectangular front frame or panel 11 including top, bottom and opposed side edges, with upper drawer openings 12 and lower drawer openings 13 therein. The upper drawer openings 12 extend substantially half the distance across the front panel 11 while the lower drawer openings 13 extend substantially the full distance across the front panel 11. Rectangular end panels 14, 14' are provided at opposite side edges of the front panel 11 and include top, bottom and front and rear opposed side edges.

Figure 6:
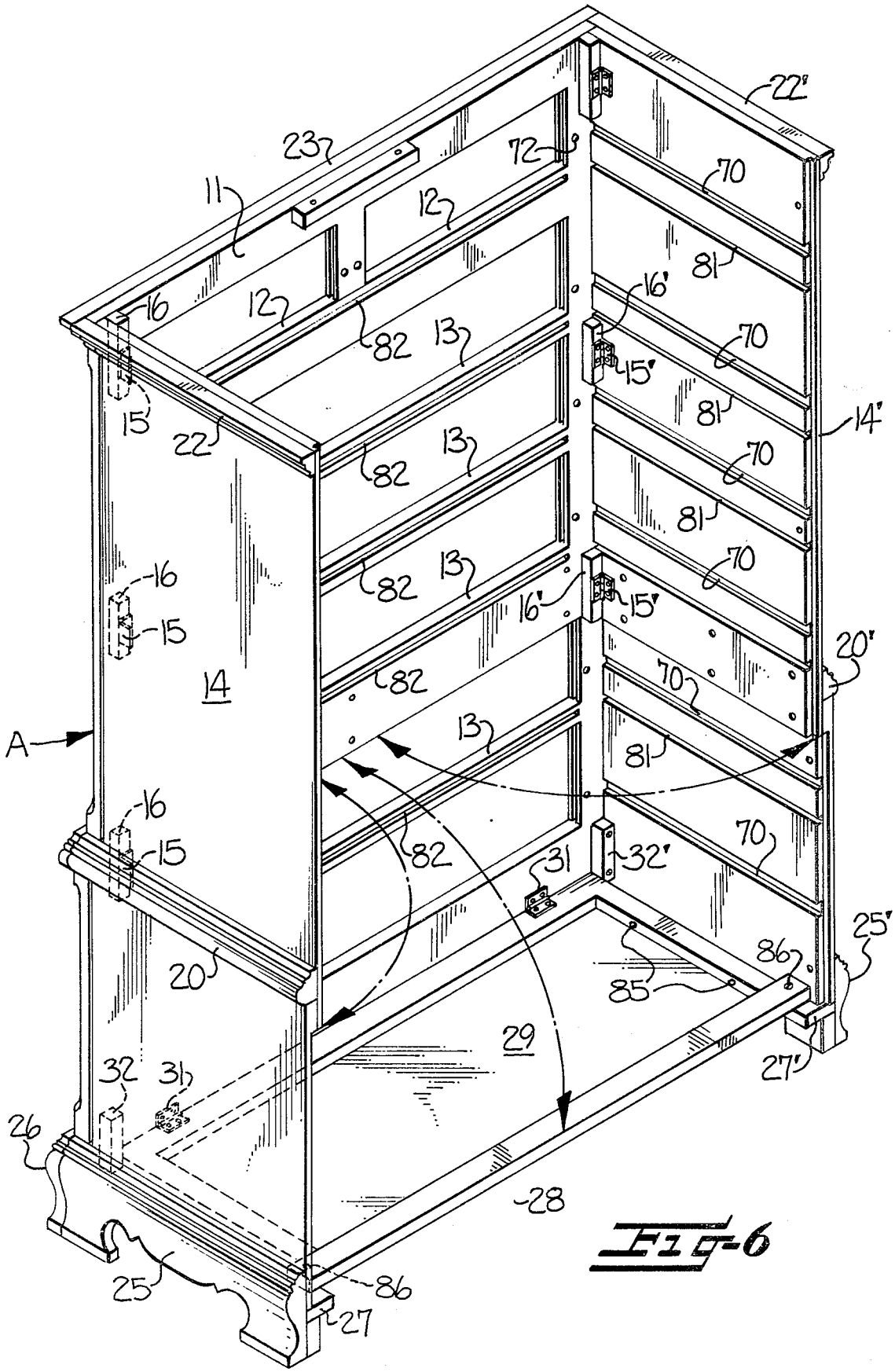
FIG. 6 is a rear isometric view of the first major component with the end panels and bottom panel in unfolded condition.

First hinge means, indicated as comprising individual hinges 15, 15', pivotally connects corresponding front side edges of each of the end panels 14, 14' to corresponding side edges of the front panel 11 so that the end panels 14, 14' may be positioned in an inwardly folded compact position parallel to the front panel 11 (FIG. 11) and so that the end panels 14, 14' may be unfolded to a position at right angles to the front panel 11 in preparation for assembly (FIGS. 6 and 10). It is preferred that one leg of each of the hinges 15, 15' be fastened directly to the corresponding end panels 14, 14' and that the other leg of the hinges be connected to corresponding spacer blocks 16, 16' fixed to the inner surface of the front panel 11.

The spacer blocks 16, 16' permit the end panels 14, 14' to be folded inwardly so that they are maintained in spaced-apart parallel relationship to the front panel 11 when in inwardly folded compact position, as shown in FIG. 11. The chest-on-chest appearance is obtained in the present article of furniture by overlapping the upper and lower portions of the front panel 11 and the end panels 14, 14' and providing a moulding strip 20, 20' on the end panels at the upper juncture of the lower portion of the end panels 14, 14' and a moulding strip 21 extending across the front panel 11 and at the juncture of the lower and upper portions thereof.

Suitable moulding pieces 22, 22' are provided on the upper ends of the end panels 14, 14' and an upper moulding strip 23 is provided across the upper end of the front panel 11. Corresponding end base plates 25, 25' are fixed to the lower ends of the corresponding ends 14, 14' and extend downwardly therefrom and include medial cutouts to provide feet for the furniture article. A front base plate 26 is fixed to the lower end of the front panel 11 and extends downwardly therefrom and has the medial portion cut away to provide feet on opposite sides thereof. Support rails 27, 27' (FIG. 6) extend inwardly from the respective end panels 14, 14' and support opposite side portions of a bottom panel 30 which includes an open frame 28 and a filler panel 29. The forward edge of the bottom panel frame 28 is hingedly connected to the lower portion of the front frame 11 by hinges 31. Spacer blocks 32, 32' are supported on the inner surface of the lower portion of the front panel 11 and adjacent opposite ends of the open frame 28.

The first major component A of the kit may be folded into a compact, knock-down condition, as illustrated in FIGS. 8 and 11, by raising the bottom panel 30 to a position adjacent to the front panel 11 and then folding the end panels 14, 14' inwardly to a position parallel to the front panel 11. As will be noted in FIG. 8, the front panel 11 and the end panels 14, 14' are spaced apart when in folded condition because the spacer blocks 16, 16' are used to support the hinges 15, 15' and the lower portions of the front panel 11 and end panels 14, 14' are further spaced apart because of the offset relationship between the upper and lower portions of the front panel 11 and the end panels 14, 14'. However, it is to be understood that the front panel 11 and end panels 14, 14' may be formed of a single piece and not offset, if desired. Also, the spacer blocks 16, 16' need not be used if a bottom panel is not employed or if the front and end panels are offset.

The second major component B includes a rectangular rear panel including top, bottom and opposed side edges and being formed of an open frame 35 with an attached filler panel 36. The second major component B also includes a rectangular top panel 37 with front, rear and opposed side edges. Second hinge means pivotally connects the rear side edge of the top panel 37 to the top side edge of the rear panel, as by spaced-apart hinges 39 fixed to the top panel 37 and the upper edge portion of the rear panel open frame 35. The filler panel 36 of the back panel is provided with vertically spaced-apart support blocks 40 (FIGS. 7 and 9) for supporting the rear portions of drawer dust panels, in a manner to be presently described. The second major component B of the compact kit may be folded into a compact knock-down condition for storage and shipment by simply hinging the upper panel 37 downwardly, as illustrated in FIG. 9. With the first major component A and the second major component B in knock-down condition, as illustrated in FIGS. 8 and 9, it is readily apparent that the volume or size of the furniture article, as illustrated in FIG. 7, is reduced substantially, to a dimension where it is less than one-half the depth of the assembled furniture article.

Figure 1:
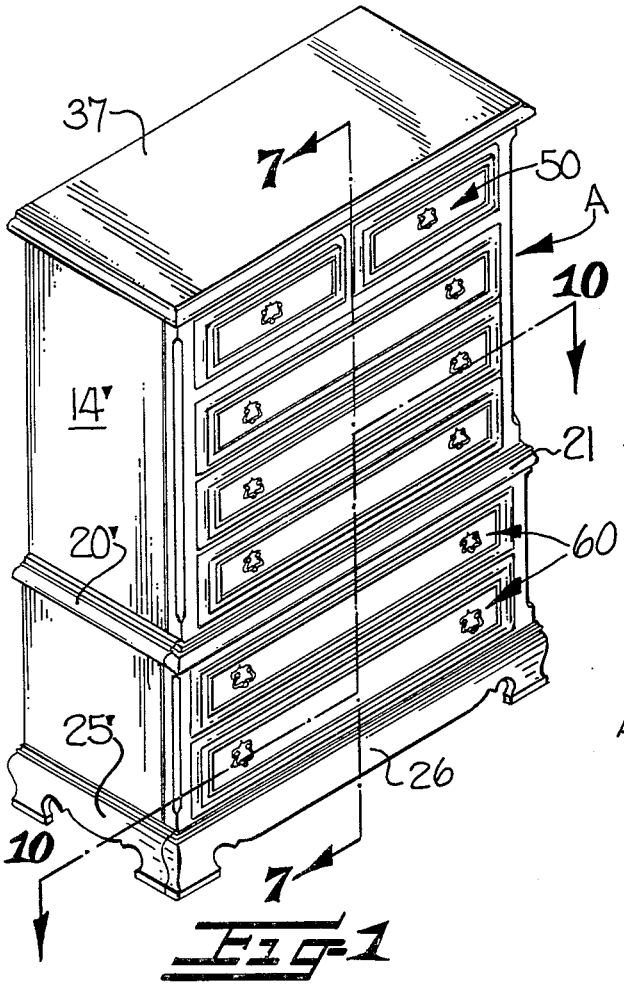
FIG. 1 is a front isometric view of the assembled article of furniture formed of the compact kit of the present invention.
Figure 2:
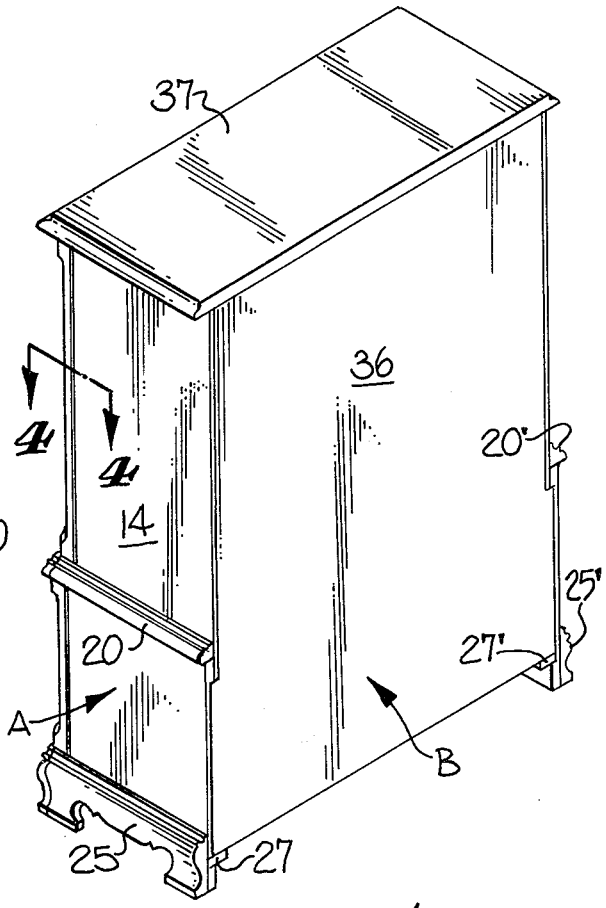
FIG. 2 is an isometric rear view of the article of furniture of FIG. 1.
Figure 3:
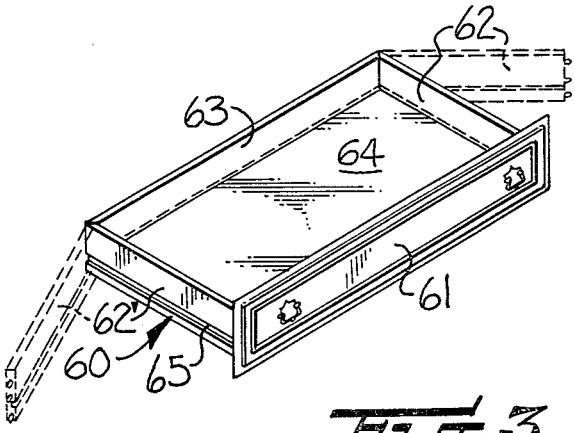
FIG. 3 is an isometric view of one of the foldable drawers and illustrating the opposed side walls in partially unfolded position in dotted lines.
Figure 4:
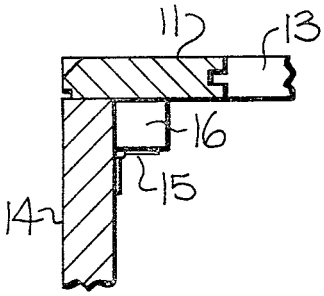
FIG. 4 is an enlarged horizontal sectional view taken substantially along the line 4—4 in FIG. 2.

Conventional knock-down type half drawers, broadly indicated at 50 in FIG. 5, and full drawers, broadly indicated at 60 in FIG. 3, are provided for sliding movement in the respective drawer openings 12 and 13 in the article of furniture. As illustrated in FIG. 5, the half-drawer 50 includes a front panel 51 and hingedly interconnected side panels 52, 52' and a rear panel 53. The inner surfaces of the side panels 52, 52', rear panel 53 and front panel 51 are grooved to receive the outer peripheral edges of a bottom drawer panel 54 when the side panels 52, 52' are folded inwardly and connected at their free ends to the front panel 51, as by suitable dowel pins or the like. The outer surfaces of the side panels 52, 52' are provided with drawer slide grooves 55 for sliding movement on drawer slides, in a manner to be presently described.

The full drawer 60 (FIG. 3) includes a front panel 61 and integrally formed and hingedly interconnected side panels 62, 62' and a rear panel 63. The inner surfaces of the side panels 62, 62', front panel 61, and rear panel 63 are grooved to receive the outer peripheral edges of a bottom drawer panel 64 when the side panels 62, 62' are folded inwardly and connected at their free ends to the front panel 61 in any suitable manner, such as by dowels. The outer surfaces of the side panels 62, 62' are provided with a drawer slide groove 65 for slidably supporting the drawer 60 on suitable drawer slides, in a manner to be presently described.

The inner surfaces of the end panels 14, 14' are provided with vertically spaced and horizontally extending drawer guide support grooves 70 (FIG. 6) which supportingly engage the outer surfaces of corresponding drawer guide slide bars 71, 71' (FIG. 5). When the end panels 14, 14' are folded outwardly to a position shown in FIG. 6, the drawer guide slide bars 71, 71' are positioned in the corresponding grooves 70 and may be glued therein. The forward ends of the slide bars 71, 71' are provided with dowels supported in dowel openings in the front panel 11. Corresponding dowel openings are provided on the inner surface of the rear open frame 35, not shown, for reception of dowels in the rear ends of the drawer guide slide bars 71, 71'.

A center drawer guide slide bar 74 (FIG. 5) is supported at its front end in dowel openings in a vertical support between the drawer openings 12 and at its rear end in a downwardly depending brace 75 on the open frame 35. Suitable dowel openings are also provided on the inner surface of the drawer brace 75 and receive corresponding dowels on the rear end of the center drawer slide bar 74. The inner surfaces of the drawer guide slide bars 71, 71' and opposite sides of the slide bar 74 may be provided with a covering of low-friction material, such as Teflon, to aid in sliding the drawers thereon. The inner surfaces of the drawer guide slide bars 71, 71' engage and slidably support the corresponding grooves 54 and 65 when the drawers 50, 60 are placed in the openings 12 and 13. Suitable dust panels 80 (FIG. 5) are provided beneath the drawers and are supported at opposite ends in grooves 81 in the end panels 14, 14'. The forward ends of the dust panels 80 are supported in grooves 82 formed in the front panel 11 (FIG. 6) positioned beneath the drawer openings 12, 13. The rear portions of the dust panels 80 are supported on the braces 40 fixed on the rear panel 36.

For storage and shipment, the first and second major components A, B are folded into a compact knock-down condition and are packed into cartons or shipping containers along with the knock-down drawers, the dust panels, and drawer guides so that they may be quickly and easily erected and assembled when ready for use. To erect and assemble the compact furniture kit, the end panels 14, 14' are unfolded and the bottom panel 30 is folded downwardly to substantially the position shown in FIG. 6. In order to add rigidity to the furniture, it is preferred that wood screws, as indicated at 84, 85, be inserted through the open frame 28 and embedded in the respective front and end panels 11, 14 and 14'. Screws 86 may also be inserted through the opposite ends of the rear rail of the open frame 28 and embedded in the support rails 27, 27'. If desired, wood glue can also be used to rigidly connect together the bottom panel 30, the front panel 11 and the end panels 14, 14'.

The drawer guide slide bars 71, 71' are then glued in position in the grooves 70 and the center drawer guide slide bar 74 is positioned in the dowel openings in the front panel 11. The dust panels 80 are then positioned in the grooves 81, 82 in the respective end panels 14, 14' and the front panel 11.

The second major component B is then readied for assembly by raising the top panel 37 and positioning it upon the upper ends of the front panel 11 and the end panels 14, 14' while the back panel is moved into position to span the distance between the end panels 14, 14'. In order to securely connect the top panel 37 to the front panel 11, a connector bar 90 is fixed to the upper central portion of the inner surface of the front panel 11 (FIG. 6) and a pair of connector bars 91 is fixed on the lower forward portion of the top panel 37 (FIG. 5). The top panel 37 is held in position at the front end by wood screws extending through the connector bar 90 and into the top panel 37 and screws extending through the bars 91 and into the front panel 11. Glue may also be used to attach the lower surface of the top panel 37 to the upper side edges of the front panel 11 and end panels 14, 14'.

The open frame 35 of the rear panel fits inside the inner edges of the end panels 14, 14' and may be suitably connected thereto as by wood screws 93 (FIG. 7), penetrating the open frame 35 and extending into the respective end panels 14, 14'. The rear panel 36 is cut to fit the grooved rear edge of the end panels 14, 14' and wood screws can be used to attach the rear rail of the open frame bottom 30 to the lower rail of the open frame rear panel 35 to add rigidity to the furniture. As the back panel is brought into assembled position, the rear end of the center slide bar 75 is raised so that the dowels therein extend into the dowel openings of the drawer brace 75.

The drawers 50, 60 are then assembled and positioned in the drawer openings 12, 13 so that they slide on the drawer slides 71, 71'. The assembly of the first major component A and the second major component B into a rigid caselike article of furniture may thus be carried out by relatively unskilled labor and in a fast and economical manner. The components are connected together in a permanent manner by the use of the screws and, if desired, adhesive or glue. The hinges connecting the parts together are hidden from view and the decorator grooves at the junctures of the end and front panels tend to obscure the fact that the ends are hingedly connected to the front panel. Thus, the furniture has the same appearance as conventional furniture with the parts permanently joined together during manufacture.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A compact readily assemblable knock-down article of furniture adapted to be assembled into a rigid caselike condition and comprising first and second major components folded into a compact knock-down condition for storage and shipment and being quickly and easily erected and permanently assembled when ready for use, (a) said first major component of said furniture article including (1) a rectangular front panel including top, bottom and opposed side edges;

(2) a pair of rectangular end panels including top, bottom, and front and rear opposed side edges, and (3) first hinge means pivotally connecting corresponding front side edges of each of said end panels to corresponding side edges of said front panel so that said end panels may be positioned in an inwardly folded compact position parallel to said front panel when in knock-down form, and so that said end panels may be unfolded to a position at right angles to said front panel in preparation for assembly, said first hinge means being hidden from frontal and side view when said end panels are in unfolded position, and (b) said second major component of said furniture article including (1) a rectangular rear panel including top, bottom and opposed side edges, (2) a rectangular top panel including front, rear and opposed side edges, (3) second hinge means pivotally connecting said rear side edge of said top panel to said top side edge of said rear panel so that said top panel may be positioned in an inwardly folded compact position against said rear panel when in knock-down form, and so that said top panel may be unfolded to a position at right angles to said rear panel in preparation for assembly, said second hinge means being hidden from frontal and side view when said top panel is in unfolded position, and (4) means for connecting opposite side edges of said rear panel with the corresponding rear side edges of the unfolded end panels, and for connecting said front side edge of the unfolded top panel with said top side edge of said front panel to thereby enable assembly of said first and second components into a rigid caselike condition with all hinge means being hidden from view.

2. An article of furniture according to claim 1 wherein said first major component further includes a rectangular bottom panel including front, rear, and opposed side edges, third hinge means pivotally connecting said front side edge of said bottom panel to said bottom side edge of said front panel, and means for connecting said rear side edge of said bottom panel to said bottom side edge of said rear panel.

3. An article of furniture according to claim 2 including means for connecting corresponding opposed side edges of said bottom panel to corresponding bottom side edge portions of said end panels.

4. An article of furniture according to claim 1 wherein the width of each of said end walls is less than one-half the width of said front panel, and wherein at least one drawer opening extends substantially the entire distance from one side to the other of said front panel.

* * * * *